US007055861B1

(12) United States Patent
Lee

(10) Patent No.: US 7,055,861 B1
(45) Date of Patent: Jun. 6, 2006

(54) BOOKMARK

(76) Inventor: Chun-yang Lee, 9F, No. 405 Chang-Ken 5th Street, kuei-san Hsiang, Taoyuan Hsien, Taiwan (CN)

( * ) Notice: Subject to any disclaimer, the term of this patent is extended or adjusted under 35 U.S.C. 154(b) by 0 days.

(21) Appl. No.: 10/069,150

(22) PCT Filed: Nov. 17, 2000

(86) PCT No.: PCT/CN00/00425

§ 371 (c)(1),
(2), (4) Date: Feb. 21, 2002

(87) PCT Pub. No.: WO01/36161

PCT Pub. Date: May 25, 2001

(30) Foreign Application Priority Data

Nov. 17, 1999 (CN) ..... 99 2 54093 U

(51) Int. Cl.
*B42D 9/00* (2006.01)

(52) U.S. Cl. ..... 281/42; 281/28; 281/36; 281/45; 281/51; 116/119; 116/234; 116/235; 116/237; 116/238; 116/239; 40/352; 40/356; 40/658; 40/666; D19/34; D19/65

(58) Field of Classification Search ..... 281/42, 281/45, 28, 36, 51; D19/34, 65; 116/234, 116/237, 238, 239, 235, 119; 40/658, 666, 40/352, 356
See application file for complete search history.

(56) References Cited

U.S. PATENT DOCUMENTS

| | | | | | |
|---|---|---|---|---|---|
| 1,540,777 | A * | 6/1925 | Hellerman | 116/239 |
| 2,096,354 | A * | 10/1937 | Bershad | 116/237 |
| 4,024,832 | A * | 5/1977 | Machnikowski | 116/237 |
| 4,162,659 | A * | 7/1979 | Burke | 116/234 |
| 4,848,799 | A * | 7/1989 | Turetsky | 156/240 |
| 4,932,351 | A * | 6/1990 | Capamaggio | 116/237 |
| 5,103,756 | A * | 4/1992 | Korkames | 116/234 |
| 5,152,553 | A * | 10/1992 | Domingo | 281/42 |
| 5,244,232 | A * | 9/1993 | Dulberger | 116/237 |
| 5,249,546 | A * | 10/1993 | Pennelle | 116/234 |
| 5,358,279 | A * | 10/1994 | Sweet | 116/237 |
| 5,515,809 | A * | 5/1996 | Weinberg | 116/235 |
| 5,904,374 | A * | 5/1999 | Lee | 116/238 |
| 6,082,772 | A * | 7/2000 | Matsumoto et al. | 116/234 |
| 6,205,947 | B1 * | 3/2001 | Drew | 116/235 |
| D449,648 | S * | 10/2001 | Andler | D19/34 |
| 6,357,797 | B1 * | 3/2002 | Lee | 281/19.1 |
| D457,561 | S * | 5/2002 | Salz et al. | D19/34 |
| 6,481,367 | B1 * | 11/2002 | McClosky | 116/235 |

* cited by examiner

*Primary Examiner*—Boyer Ashley
*Assistant Examiner*—Mark Henderson
(74) *Attorney, Agent, or Firm*—Ying Tuo

(57) ABSTRACT

Described is a bookmark having a bookmark body, on which a bookmark clip is disposed. The bookmark clip can clam the cover or inner pages of a book to prevent the bookmark body from falling off from the book. The bookmark body is bendable and includes a protection surface of mounting the bookmark clip, a bendable surface and folding sheet capable of being inserted into content pages of a book. The bookmark can be repeatedly used for many times while having the features of being simple in structure, easy to manufacture, and flexible and convenient to use.

4 Claims, 11 Drawing Sheets

BOOKMARK

CROSS REFERENCES

The present invention relates to U.S. Pat. No. 5,904,374 issued to the same inventor. The U.S. Patent discloses a cover member of a book, which includes a bookmark having at least one foldable bookmark flap integrally formed on a longitudinal edge of the book cover, or a dust cover of the book, or a foldable flap integrally secured to an upper edge or a bottom edge of the cover. When the bookmark flap is folded and inserted between inner pages of the book, the bookmark conveniently marks a page location of reading interest in the book. The flap inserted into the pages of the book also protects the pages from dust contamination or atmospheric oxidation. The present invention further relates to a co-pending U.S. patent application Ser. No. 09/743,961 by the same inventor, which discloses a novel book cover capable of being used as a bookmark.

FIELD OF THE INVENTION

The present invention relates to a bookmark, in particular, to a bookmark having a clip which can be conveniently clamped onto a book without damaging the book.

BACKGROUND OF THE INVENTION

FIG. 1 shows an existing bookmark having a plurality of parallel folding lines. The bookmark particularly includes a bookmark body 10 and an adhesive surface 14. The bookmark body 10 includes a protective surface 11; a folding sheet 12 that can be inserted into a book and a bending surface 13 having a plurality of parallel folding lines 15. When in use, the adhesive surface 14 is adhesively attached to the cover of a book, and the folding sheet 12 is inserted into inner pages of the book to mark a page location of reading interest. However, if the viscidity on the adhesive surface 14 is too strong, it will inevitably damage the papers of the book when peeling off the adhesive surface 14 from the book. Consequently, a bookmark can be only used on one book and it is impossible to move the bookmark to another book for reuse. On the other hand, if the viscidity on the adhesive surface 14 is too weak, after several uses, the adhesiveness on the surface 14 will gradually decrease and disappear, thus causing the bookmark losing its utility and shortening the using life of the bookmark.

SUMMARY OF INVENTION

One objective of the present invention is to provide a bookmark, which can be repeatedly used for many times while having features of being simple in structure, easy to manufacture, and flexible and convenient to use.

To achieve the above objective, the present invention provides a bookmark having a bookmark body which includes a clip, which is disposed on the bookmark body and is capable of clamping onto the book cover or the inner pages of a book so as to prevent the bookmark body from dropping off. The bookmark body is bendable and includes a protection surface for mounting the bookmark clip, a bendable surface and a folding sheet insertable into the content pages of a book.

The clip can be made of plastic, metal sheet or other resilient materials.

The clip can be adhesively mounted on the bookmark body, or be mounted on the bookmark body by inserting the clip into perforations or slots on the bookmark body.

The bookmark body can be a plastic bag. The protective surface and the folding sheet are disposed at the two opposite ends of the plastic bag respectively. There is a gap between the protective surface and the folding sheet. The plastic bag portion within the gap can be used as a bending surface.

The protective surface and folding sheet described above can be mounted to the plastic bag through heat melting.

In the above-described bookmark, the bookmark body and the clip can be made as one unit using one material with a lateral side of the bookmark body being corrugated to form a clip.

DETAILED DESCRIPTION OF THE PREFERRED EMBODIMENTS

Figure 1:
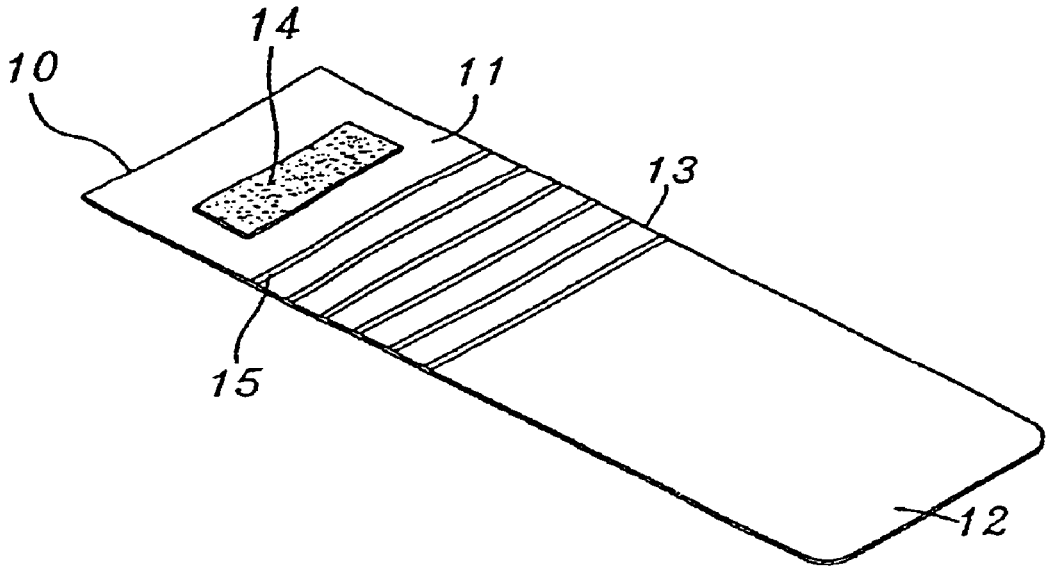
FIG. 1 is the schematic diagram of an existing bookmark.
Figure 2A:
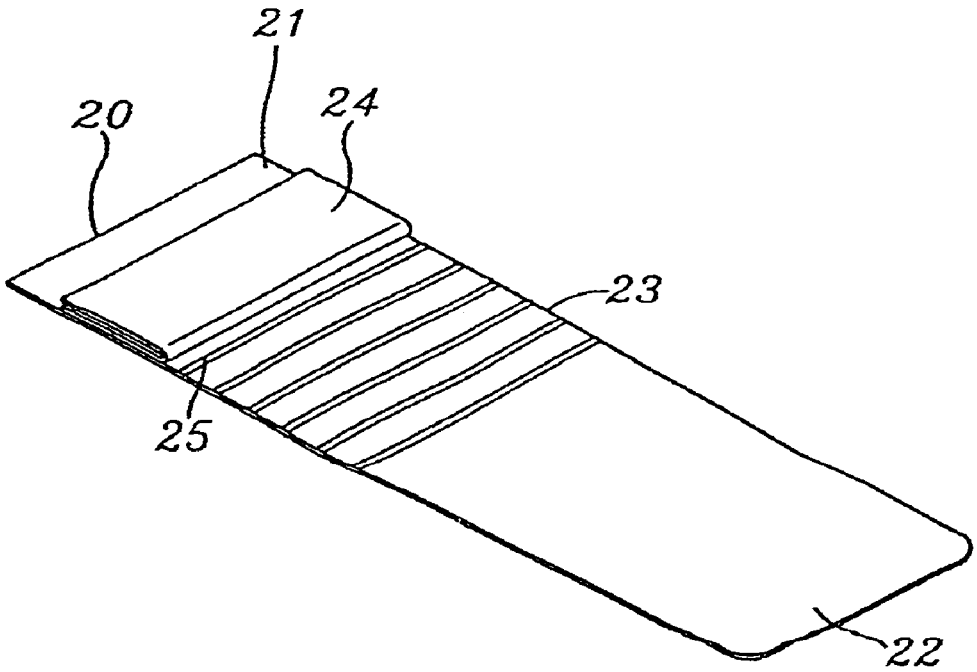
FIG. 2A is a perspective view of a first embodiment of the present invention.
Figure 2B:
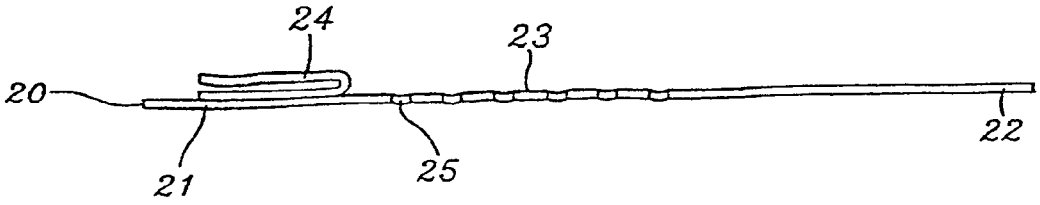
FIG. 2B is a side view of the first embodiment of the present invention.
Figure 2C:
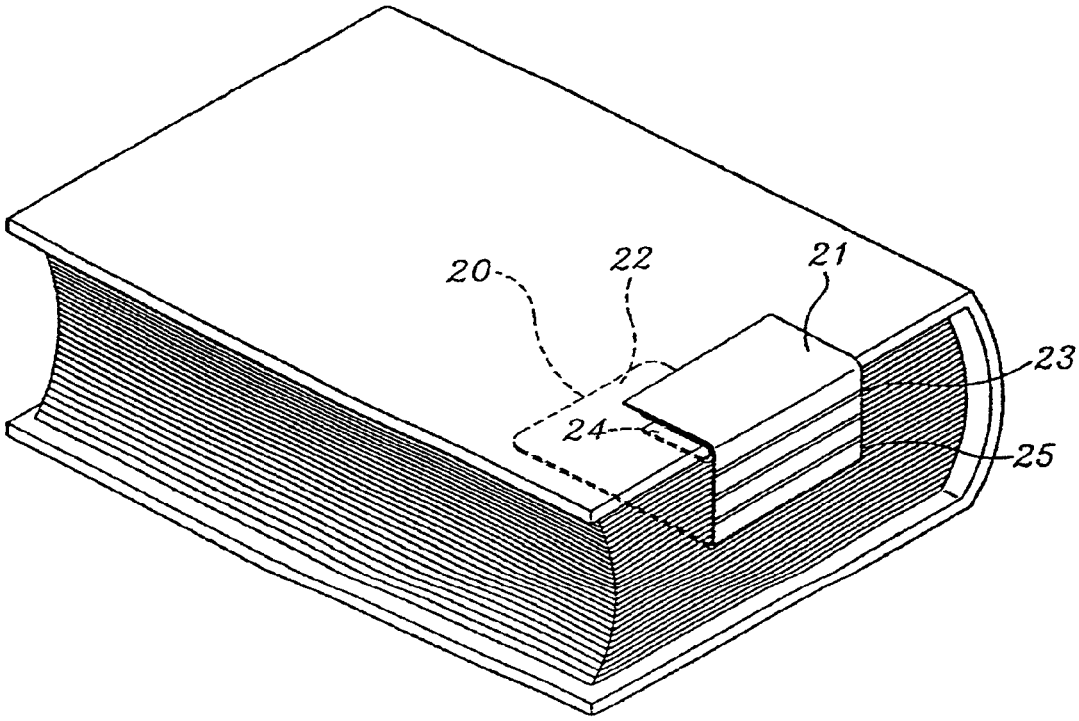
FIG. 2C is a perspective view of the using state of the first embodiment of the present invention.

FIGS. 2A and 2B show a first embodiment of the present invention, which includes a bookmark body 20 and a clip 24. The clip 24 is mounted on the bookmark body 20. The bookmark body 20 is bendable and includes a protective surface 21, a folding sheet 22 that can be inserted into the inner pages of a book, and a folding surface 23. The folding surface 23 is made of bendable material and its surface can be made to have a plurality of parallel folding lines 25. As shown in FIG. 2C, when in use, the clip 24 clamps the cover of a book (or some inner pages of the book). The bookmark body 20 can be then bended to insert the folding sheet 22 between two inner pages from the upside or underside of the book to mark a place of reading emphasis. If a reader needs to mark multiple reading emphases, several bookmarks of this type can be conveniently used.

The clip is only required capable of clamping papers of a book, and there is no special limitation on its structure.

The clip of the bookmark can be made of metal, plastic, or other resilient materials.

The clip can be adhesively mounted on the bookmark body, or be mounted on the bookmark body by inserting the clip into perforations or slots on the bookmark body.

Figure 2D:
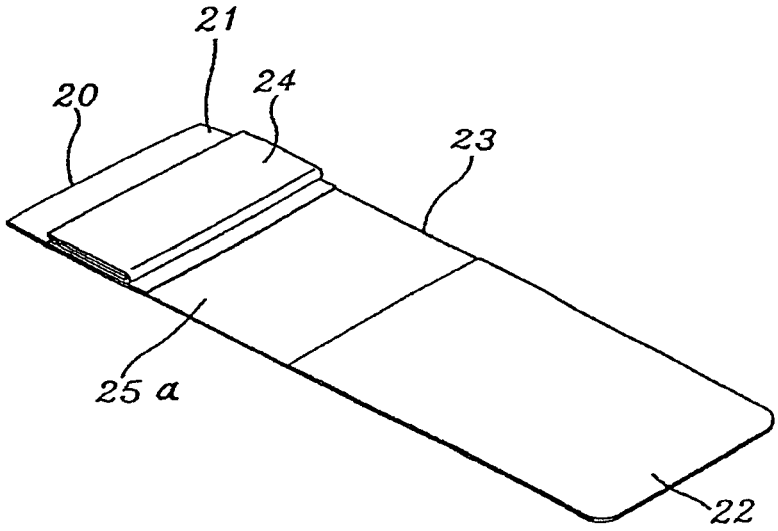
FIG. 2D is a perspective view of a second embodiment of the present invention.
Figure 2E:
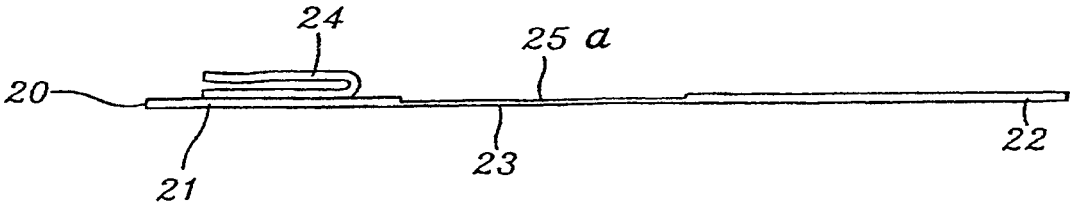
FIG. 2E is a side view of the second embodiment of the present invention.

FIGS. 2D and 2E show a second embodiment of the present invention illustrating another type of bookmark with a clip. The second embodiment bookmark includes a bookmark body 20 and a clip 24 mounted on the bookmark body. The bookmark body 20 is bendable and includes a protective surface 21, a folding sheet 22 that can be inserted into inner pages of a book, and a folding surface 23. The folding surface 23 can be made of resilient materials and its surface can be made to have a groove 25*a*.

Figure 3A:
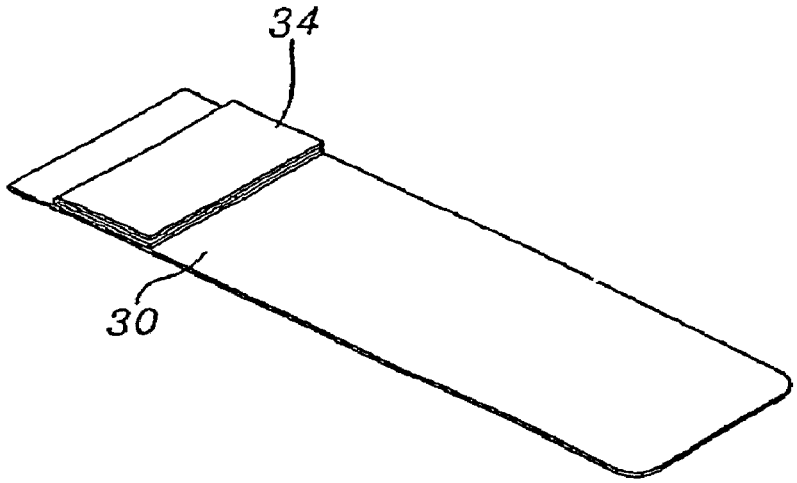
FIG. 3A is a perspective view of a third embodiment of the present invention.
Figure 3B:
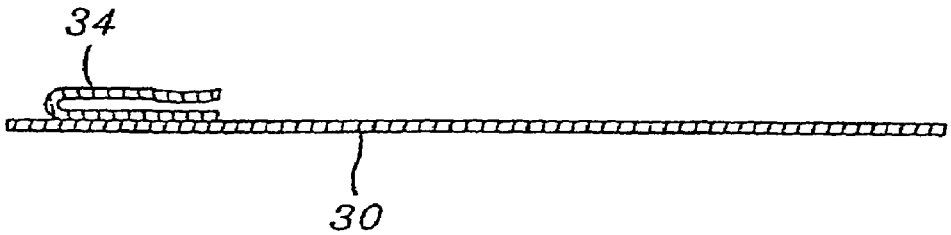
FIG. 3B is a side view of the third embodiment of the present invention.
Figure 3C:
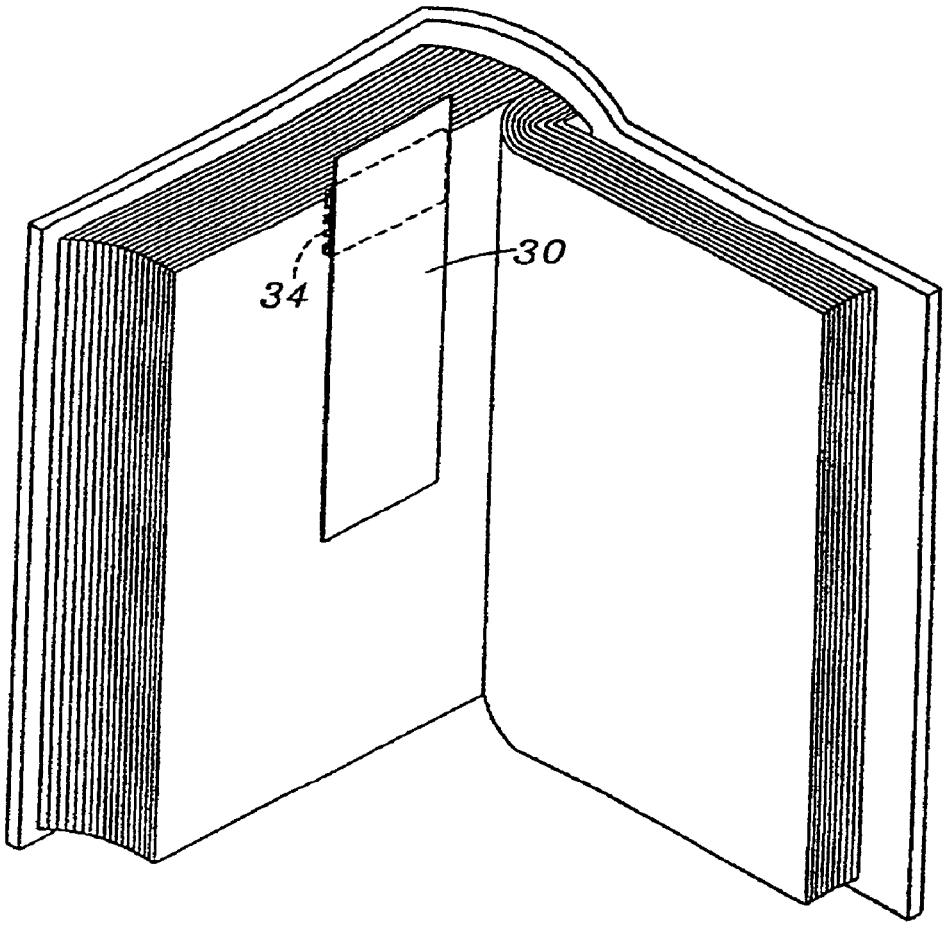
FIG. 3C is the using state of the third embodiment of the present invention.

FIGS. 3A and 3B show a third embodiment of the present invention illustrating a hard board clip bookmark, which includes a bookmark body 30 and a clip 34. The clip 34 is mounted on the bookmark body 30. In its using state, as illustrated in a schematic diagram shown in FIG. 3C, the clip 34 directly clamps inner pages of a book to mark page locations of reading interest. The using methods and number of the bookmarks are not limited to what have shown in FIG. 3C. Users can adjust using methods according to their own preferences.

Figure 3D:
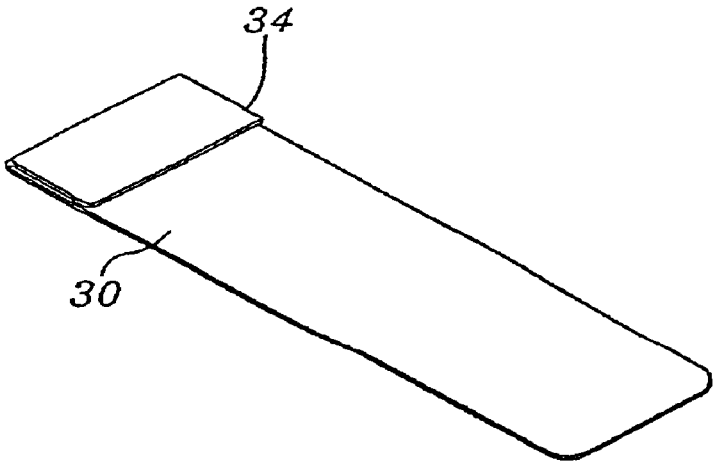
FIG. 3D is a perspective view of a fourth embodiment of the present invention.
Figure 3E:
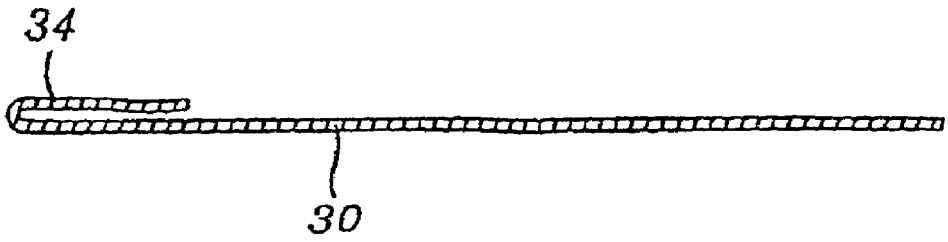
FIG. 3E is a side view of the fourth embodiment of the present invention.

FIGS. 3D and 3E show a fourth embodiment of the present invention illustrating a hard board clip bookmark, which includes a bookmark body 30 and a clip 34. The bookmark body 30 and clip 34 are made as one unit using one material. The clip 34 is formed by folding one lateral side of the bookmark body.

Figure 4A:
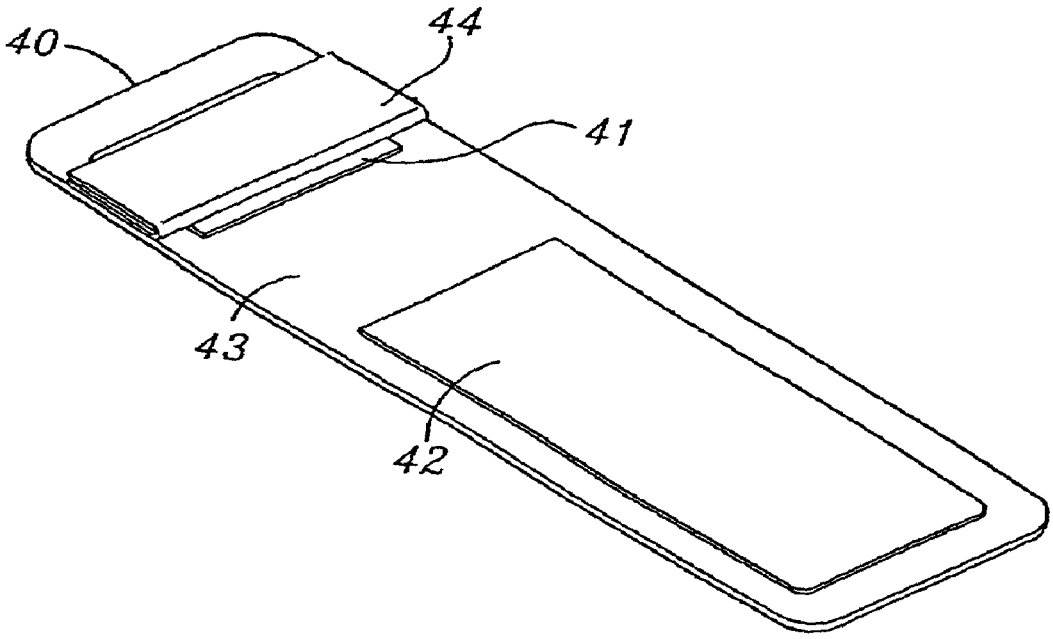
FIG. 4A is a perspective view of a fifth embodiment of the present invention.
Figure 4B:
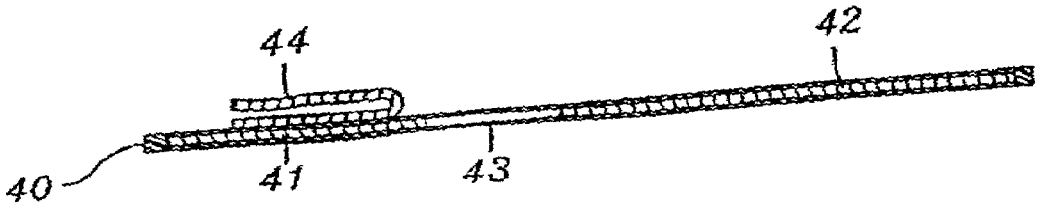
FIG. 4B is a side view of the fifth embodiment of the present invention.

FIGS. 4A and 4B show a fifth embodiment of the present invention illustrating a bookmark which includes a bookmark body 40 and a clip 44. The bookmark body 40 can be a plastic bag, which includes a protective surface 41 and a folding sheet 42 that are placed at the two ends of the plastic bag. The folding sheet 42 can be inserted into inner pages of a book. The protective surface 41 and the folding sheet 42 are made of paper or plastic sheet. Because the plastic bag is bendable, the plastic bag surface portion between the protective surface 41 and the folding sheet 42 can be used as a bending surface 43 of the bookmark body 40. The clip 44 can be mounted on the plastic bag surface at the upper side of the protective surface 40.

Figure 5A:
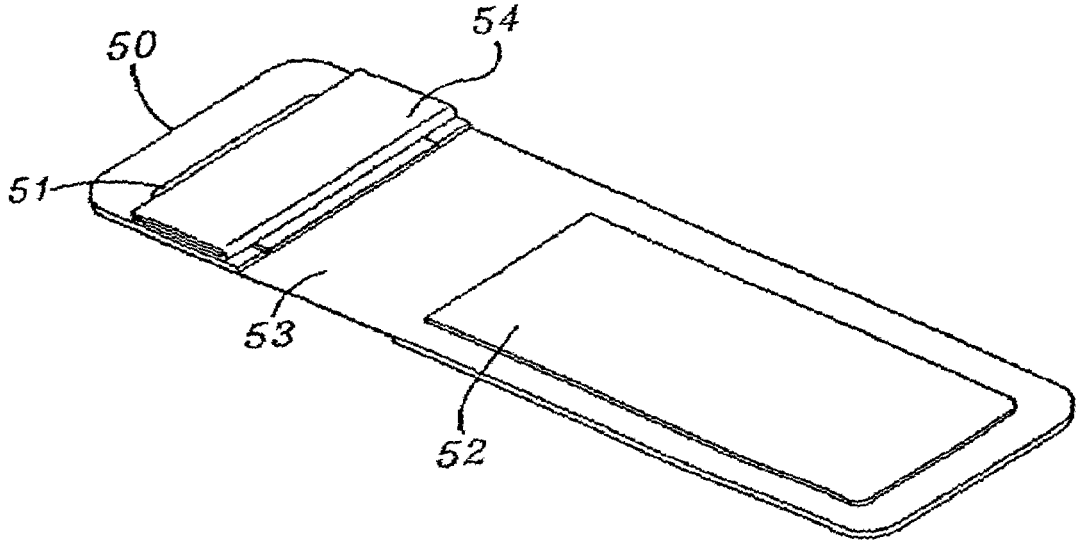
FIG. 5A is a perspective view of a sixth embodiment of the present invention.
Figure 5B:
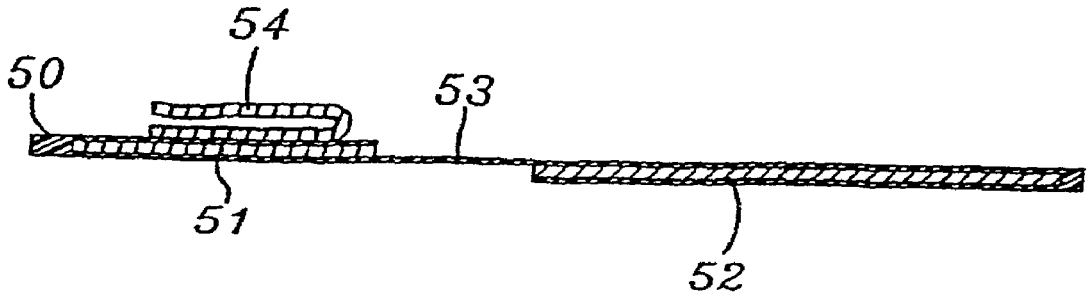
FIG. 5B is a side view of the sixth embodiment of the present invention.

FIGS. 5A and 5B show a sixth embodiment of the present invention illustrating a bookmark which includes a bookmark body 50 and a clip 54. The bookmark body 50 is made of paper, plastic sheet, or like materials, which are heat melted into a plastic film. The plastic film between the protective surface 51 and the folding sheet 52 can be used as the bending surface 53 of the bookmark body 50. The surface can be made to have a plurality of parallel folding lines or a groove. The clip 54 is mounted on the protective surface 51 of the bookmark body 50.

Figure 6A:
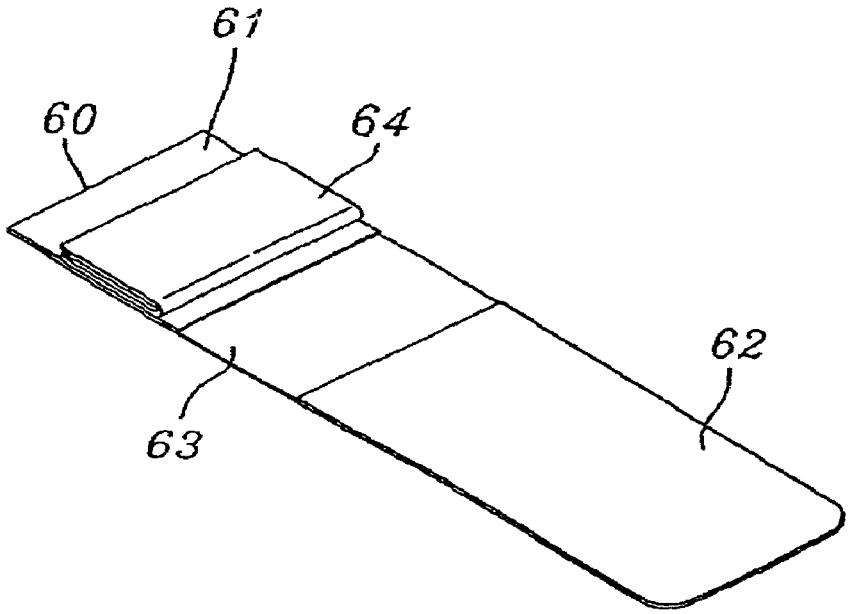
FIG. 6A is a perspective view of a seventh embodiment of the present invention.
Figure 6B:
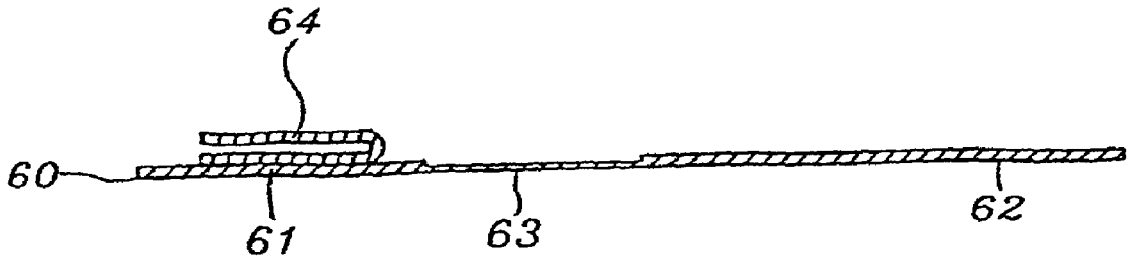
FIG. 6B is a side view of the seventh embodiment of the present invention.

FIGS. 6A and 6B show a seventh embodiment of the present invention illustrating a bookmark, which includes a bookmark body 60 and a clip 64. The bookmark body 60 is made of resilient materials and includes a protective surface 61, a folding sheet 62 capable of being inserted into the inner pages of a book, and a bending surface 63. The bending surface 63 can be made to have a plurality of parallel folding lines or a groove. The clip 64 is mounted on the protective surface 61.

Figure 7A:
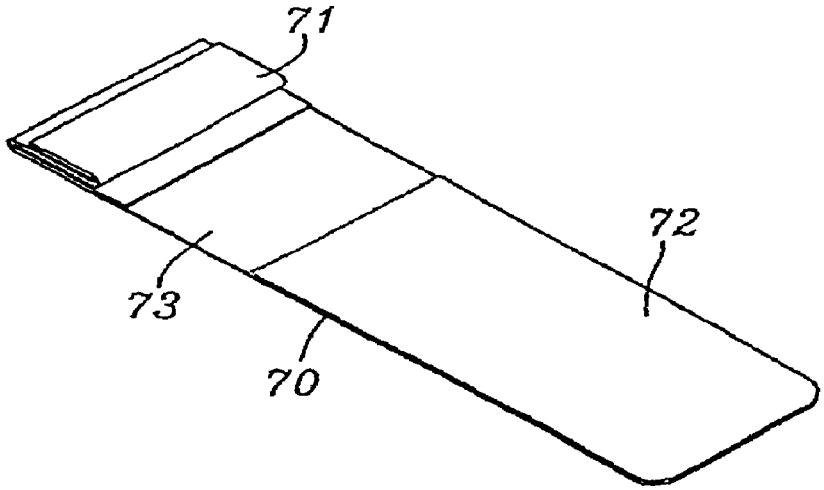
FIG. 7A is a perspective view of a eighth embodiment of the present invention.
Figure 7B:
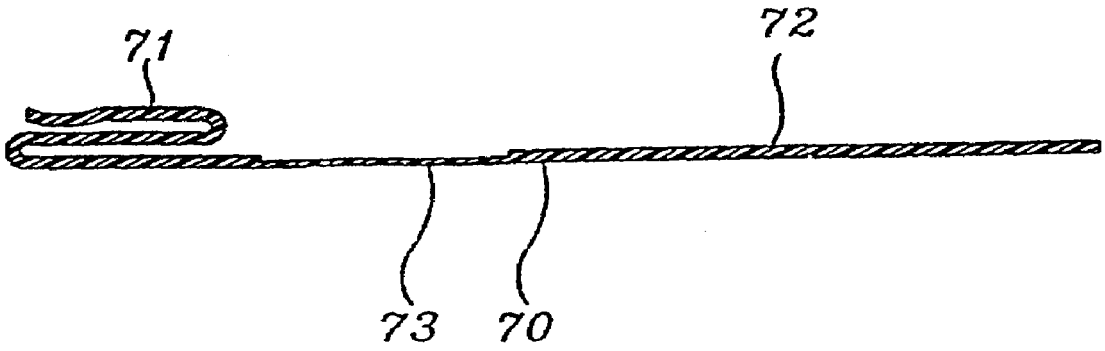
FIG. 7B is a side view of the eighth embodiment of the present invention.

FIGS. 7A and 7B show an eighth embodiment of the present invention illustrating a bookmark, which includes a bookmark body 70 made of a bendable material. The bookmark body 70 further includes a protective surface 71, a folding sheet 72 capable of being inserted into the inner pages of a book, and a bending surface 73. The bending surface 73 can be made to have a plurality of parallel folding lines or a groove. The protective surface 71 is formed in corrugated shape and can function as a clip.

Figure 8A:
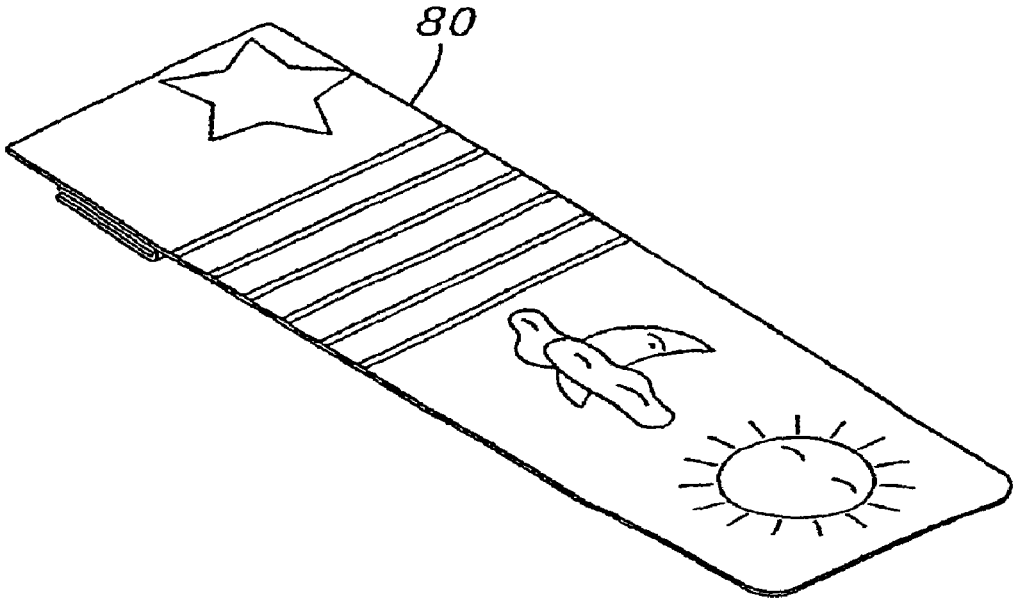
FIG. 8A is a perspective view of a ninth embodiment of the present invention.
Figure 8B:
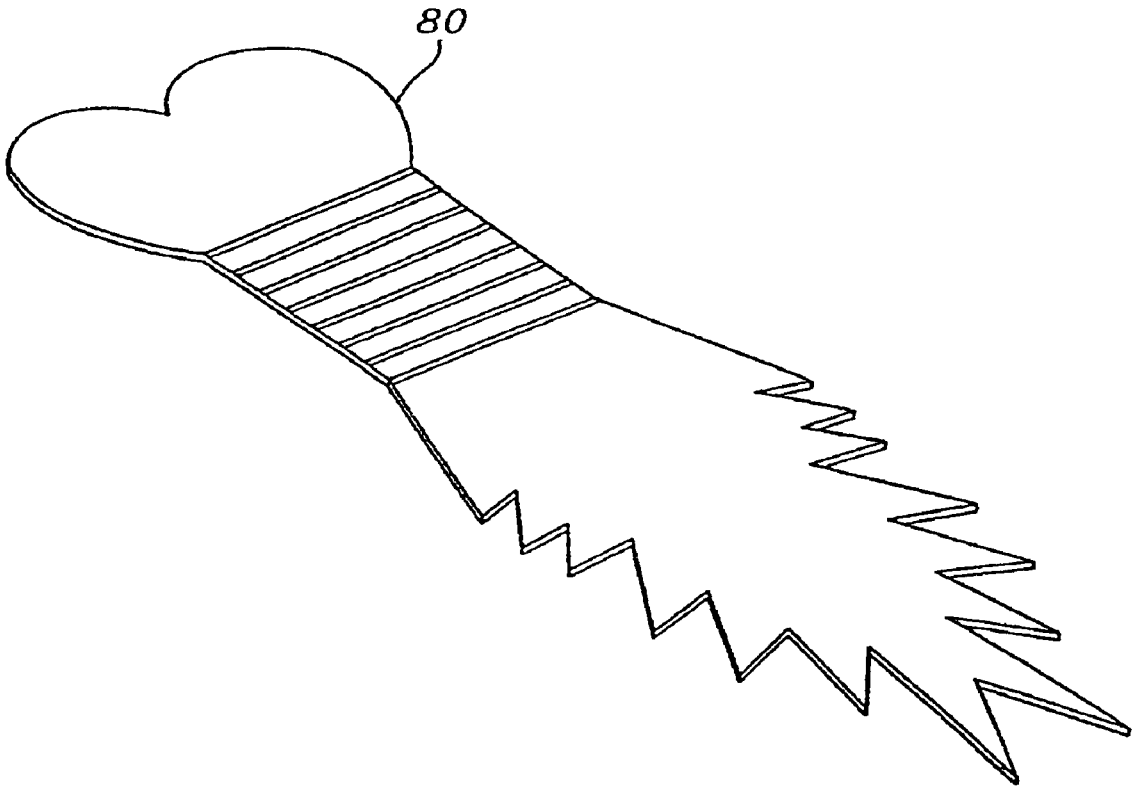
FIG. 8B is also a perspective view of a ninth embodiment of the present invention.

FIGS. 8A and 8B show a ninth embodiment of the present invention illustrating a bookmark, in which the bookmark body 80 can be painted with decorative patterns or made into various artistic forms for being used as a small book-card or a business-card etc.

UTILITY IN INDUSTRY

It should be clear from the above-described embodiments that the novel bookmark of the present invention has the following advantages:

1. The bookmark clip can clamp the inner pages or the cover page of a book without dropping off, when a user uses the bookmark to mark reading emphasizes in a book. The bookmark can be easily removed without damaging the papers of the book.

2. The bookmark is removable from one book to another to be reused in different books.

3. The bookmark body can be painted with decorative patterns or made into various artistic forms for being used as small book-card or business card etc.

The invention claimed is:

1. A bookmark comprising:

a bookmark body (20) including a bookmark clip (24) that is mounted on the bookmark body (20) to clamp the cover of a book or at least one content page of the book;

wherein the bookmark clip (24) has a width that is substantially equal to that of the bookmark body (20);

wherein the bookmark body (20) has a protective surface (21) on which the bookmark clip (24) is mounted, has a bendable folding surface (23) extending from the protective surface (21), and has a folding sheet (22) extending from the folding surface (23), thereby when bendable folding surface (23) is bent over one or more pages of the book, the folding sheet (22) is inserted between two inner pages of the book; and wherein the bookmark body is a plastic bag (40), wherein the protective surface (41) is disposed at one end of the plastic bag (40), the folding sheet (42) is disposed at the other end of the plastic bag (40), and the folding surface (43) is formed on the plastic bag (40) between the protective surface (41) and the folding sheet (42).

2. The bookmark according to claim 1, wherein the bookmark clip (24) is made of plastic, metal or other resilient material.

3. The bookmark according to claim 1, wherein the folding surface (23) includes a plurality of parallel folding lines or a groove.

4. The bookmark according to claim 1, wherein the bookmark clip is adhesively mounted on the bookmark body (20).

* * * * *